US007467659B2

(12) United States Patent
Nielsen et al.

(10) Patent No.: US 7,467,659 B2
(45) Date of Patent: Dec. 23, 2008

(54) TUBING INJECTOR HEAD

(76) Inventors: Shawn James Nielsen, 3 Miller Avenue, Spruce Grove, Alberta (CA) T7X 2L9; Sinisa Dobrijevic, 1809 Garnett Way, Edmonton, Alta (CA) T5T 6R1

( * ) Notice: Subject to any disclaimer, the term of this patent is extended or adjusted under 35 U.S.C. 154(b) by 14 days.

(21) Appl. No.: 11/607,440

(22) Filed: Dec. 1, 2006

(65) Prior Publication Data

US 2007/0137855 A1 Jun. 21, 2007

(51) Int. Cl.
*E21B 19/22* (2006.01)

(52) U.S. Cl. ..... 166/77.3; 166/77.2; 166/85.1

(58) Field of Classification Search ..... 166/77.2, 166/77.3, 85.1

See application file for complete search history.

(56) References Cited

U.S. PATENT DOCUMENTS

| | | | | |
|---|---|---|---|---|
| 3,559,905 | A | 2/1971 | Palynchuk | |
| 5,133,405 | A | 7/1992 | Elliston | |
| 5,309,990 | A | 5/1994 | Lance | |
| 5,553,668 | A | 9/1996 | Council et al. | |
| 5,738,173 | A | 4/1998 | Burge et al. | |
| 5,845,708 | A | 12/1998 | Burge et al. | |
| 5,850,874 | A | 12/1998 | Burge et al. | |
| 6,082,454 | A | 7/2000 | Tubel | |
| 6,116,345 | A | 9/2000 | Fontana et al. | |
| 6,209,634 | B1 | 4/2001 | Avakov et al. | |
| 6,216,780 | B1 * | 4/2001 | Goode et al. | 166/77.3 |
| 6,276,454 | B1 | 8/2001 | Fontana et al. | |
| 6,347,664 | B1 * | 2/2002 | Perio, Jr. | 166/77.3 |
| 6,609,566 | B2 * | 8/2003 | Perio, Jr. | 166/77.3 |
| 6,719,043 | B2 | 4/2004 | Austbo et al. | |
| 6,968,894 | B2 * | 11/2005 | Austbo et al. | 166/77.3 |
| 7,124,815 | B2 * | 10/2006 | Rosine et al. | 166/77.3 |

* cited by examiner

*Primary Examiner*—Shane Bomar
(74) *Attorney, Agent, or Firm*—Davis Bujold & Daniels, PLLC

(57) ABSTRACT

A tubing injector head, includes a main body adapted for mounting on a well. A pair of gripper chain supports are mounted to the main body. Each gripper chain support has an upper chain sprocket at an upper end and a lower chain sprocket at a lower end. A drive motor drives the upper chain sprocket to move a gripper chain along a bearing surface. A tubing channel is positioned between the gripper chain supports. Telescopic cylinders are provided for creating relative movement of the gripper chain supports, while maintaining the first bearing surface and the second bearing surface in parallel spaced relation. The telescopic cylinders move the gripper chains into or out of engagement with tubing positioned in the tubing channel.

5 Claims, 6 Drawing Sheets

TUBING INJECTOR HEAD

This application claims priority from Canadian Application Serial No. 2,530,076 filed Dec. 2, 2005.

FIELD OF THE INVENTION

The present invention relates to an injector head used to inject coil tubing or other tubular strings into a well.

BACKGROUND OF THE INVENTION

There are a number of existing patents relating to the structure of tubing injector heads, such as: U.S. Pat. No. 5,553,668 (Council et al 1996); U.S. Pat. No. 6,209,634 (Avakov et al 2001); U.S. Pat. No. 6,719,043 (Austbo et al 2004). These systems use a roller chain drive system that drives a gripper chain. The roller chain passes over a linear pressure beam. The roller chain has an outer side which engages an inner side of the gripper chain.

SUMMARY OF THE INVENTION

According to the present invention there is provided a tubing injector head, which includes a main body adapted for mounting on a well. A first gripper chain support is mounted to the main body. The first gripper chain support has an upper end, a lower end, and a first bearing surface extending between the upper end and the lower end. An upper chain sprocket is positioned at the upper end and a lower chain sprocket is positioned at the lower end. A first gripper chain engages the upper chain sprocket and the lower chain sprocket. A first drive motor drives either the upper chain sprocket or the lower chain sprocket to move the first gripper chain along the first bearing surface. A second gripper chain support is similarly mounted to the main body. The second gripper chain support also has an upper end, a lower end and a second bearing surface extending between the upper end and the lower end. An upper chain sprocket is positioned at the upper end and a lower chain sprocket is positioned at the lower end. A second gripper chain engages the upper chain sprocket and the lower chain sprocket. A second drive motor drives either the upper chain sprocket or the lower chain sprocket to move the second gripper chain along the second bearing surface. A tubing channel positioned between the first gripper chain support and the second gripper chain support.

Means are provided for creating relative movement of the first gripper chain support and the second gripper chain support while maintaining the first bearing surface and the second bearing surface in parallel spaced relation, whereby the first gripper chain and the second gripper chain can be moved into or out of engagement with tubing positioned in the tubing channel.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
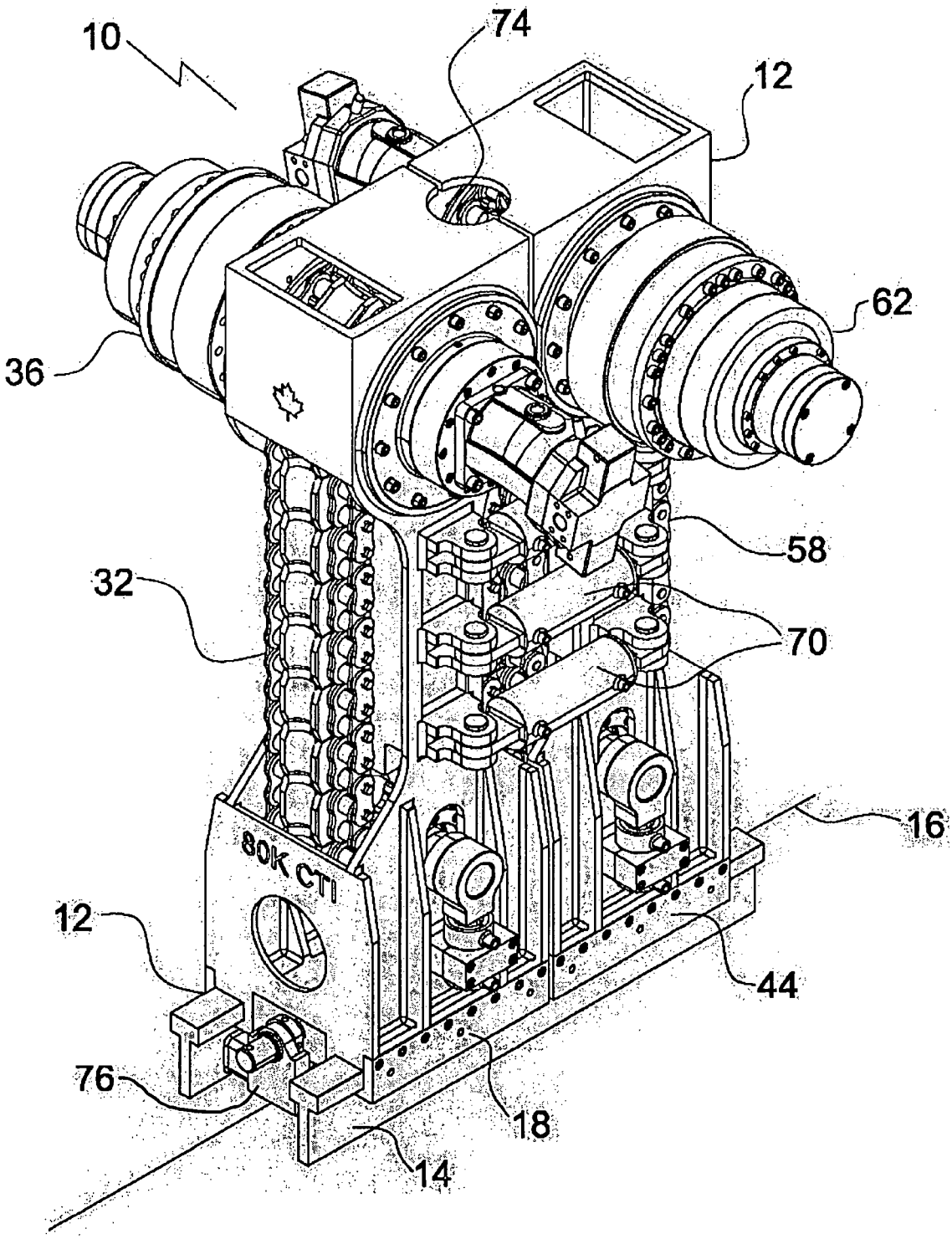
FIG. 1 is a perspective view of a tubing injector head constructed in accordance with the teachings of the present invention.

The preferred embodiment, a tubing injector head generally identified by reference numeral 10, will now be described with reference to FIGS. 1 through 6.

Structure and Relationship of Parts:

Referring now to FIG. 1, there is shown tubing injector head 10, including a main body 12 adapted for mounting on a well (not shown) and a "T", shaped load distributing mounting track 14 with an axis 16.

Figure 2:
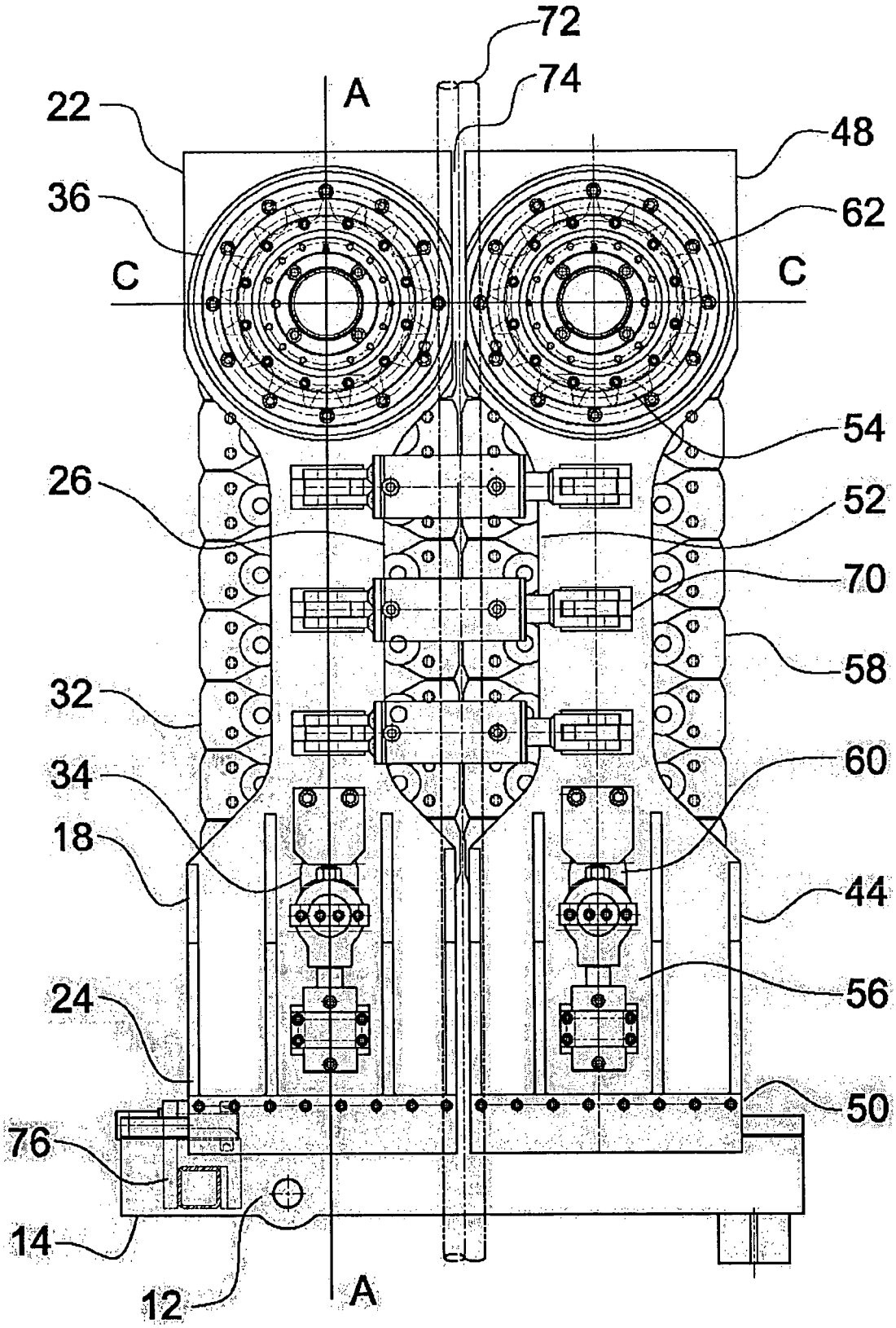
FIG. 2 is a side elevation view, in section, of the tubing injector head illustrated in FIG. 1.
Figure 3:
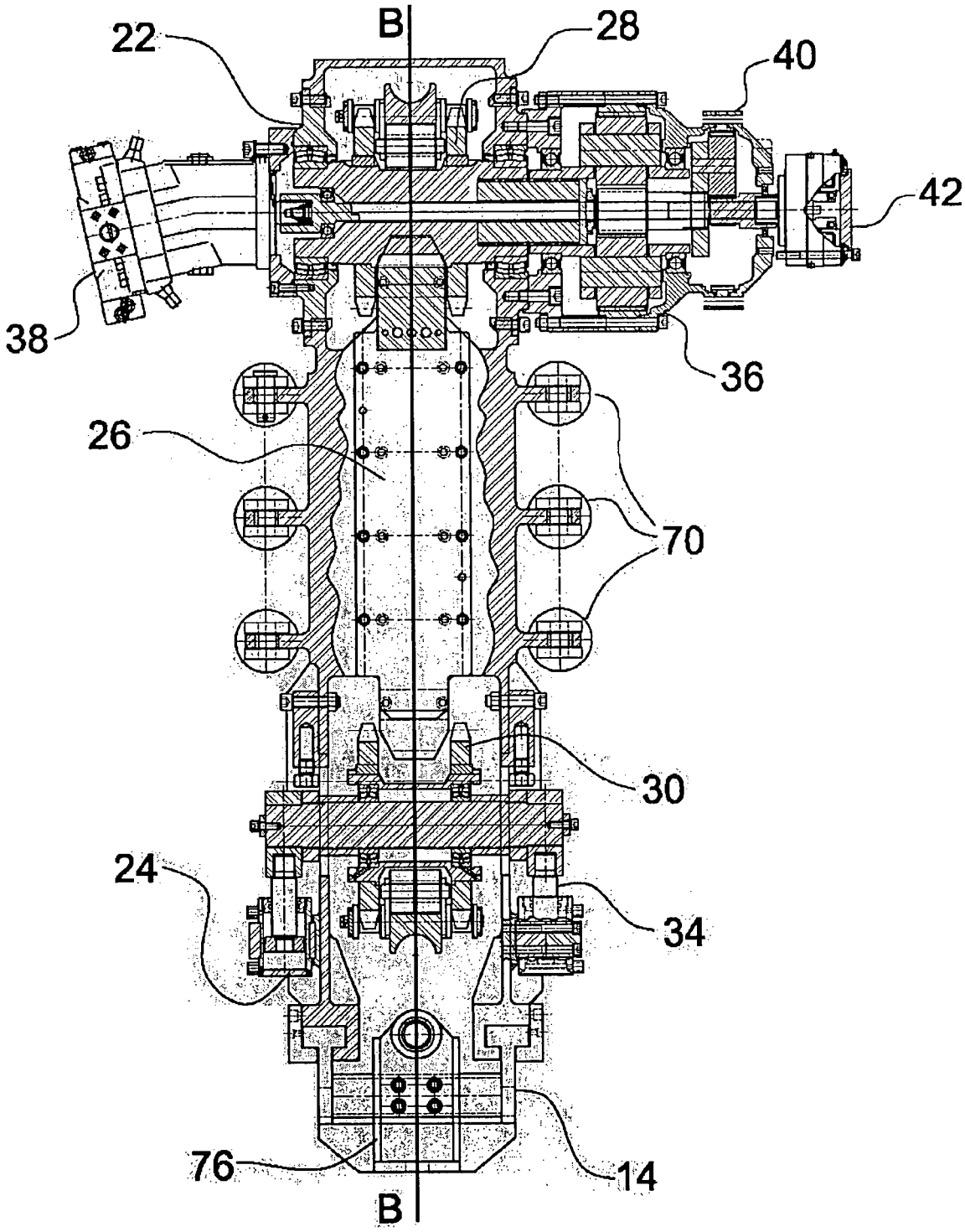
FIG. 3 is an end elevation view, in section, of the tubing injector head taken along section lines A-A of FIG. 2.
Figure 4:
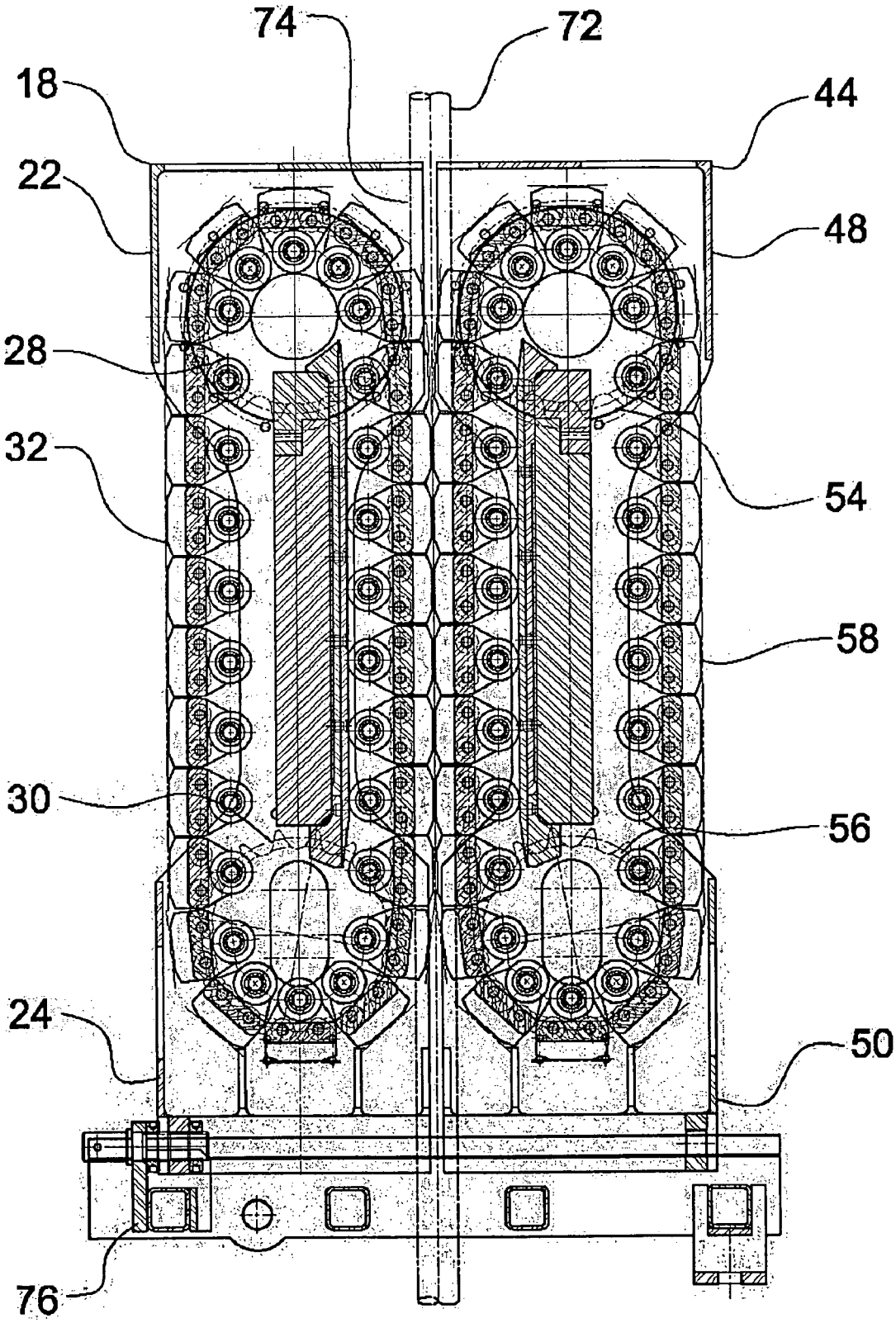
FIG. 4 is a side elevation view, in section, of the tubing injector head taken along section lines B-B of FIG. 3.

Referring to FIG. 2, a first gripper chain support 18 is mounted on mounting track 14 of main body 12 and facilitates axial movement of first gripper chain support 18 while precluding transverse movement. Referring to FIG. 3, first gripper chain support 18 has an upper end 22, a lower end 24, and a first skate plate 26 providing a first bearing surface that extends between upper end 22 and lower end 24. Referring to FIG. 4, first gripper chain support 18 also has an upper chain sprocket 28 at upper end 22, a lower chain sprocket 30 at lower end 24, and a first gripper chain 32 engaged with upper chain sprocket 28 and lower chain sprocket 30. Referring again to FIG. 3, there is a first tensioning cylinder 34 adapted to exert a force upon lower chain sprocket 30 of first gripper chain support 18 to cause relative movement of upper chain sprocket 28 and lower chain sprocket 30 to tension first gripper chain 32. A first drive motor assembly 36 that consists of a motor 38, gear box 40 and brake 42 is used to drive upper chain sprocket 28 to move first gripper chain 32 along first bearing surface provided by first skate plate 26.

Figure 5:
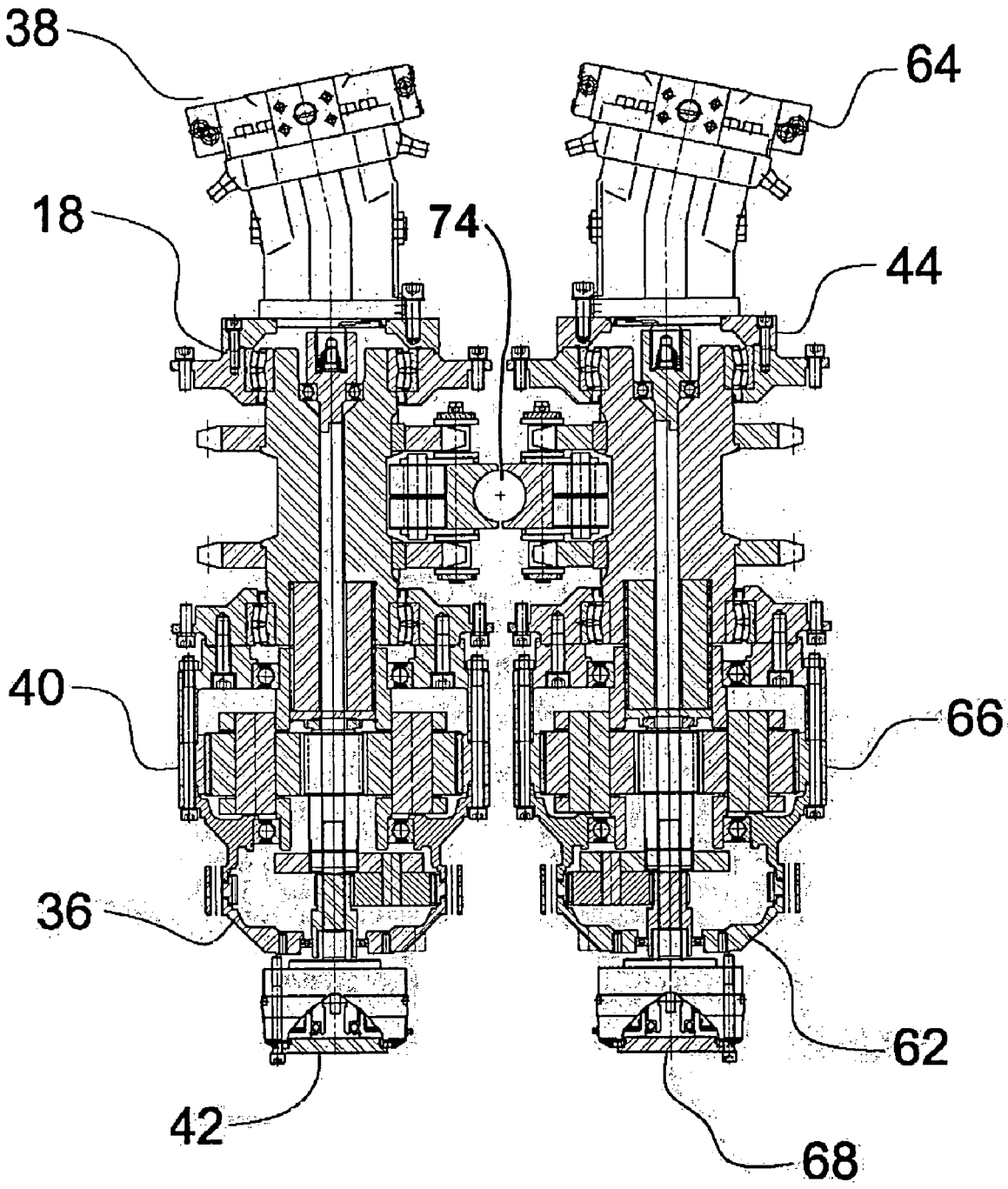
FIG. 5 is a top plan view, in section, of the tubing injector head taken along section lines C-C of FIG. 2.

Similarly, referring again to FIG. 2, a second gripper chain support 44 is mounted on mounting track 14 of main body 12, and facilitates axial movement of second gripper chain support 46 while precluding transverse movement. Referring to FIG. 4, second gripper chain support 44 has an upper end 48, a lower end 50, and a second skate plate 52 which provides a second bearing surface that extends between upper end 48 and lower end 50. Second gripper chain support 44 also has an upper chain sprocket 54 at upper end 48, a lower chain sprocket 56 at lower end 50, and a second gripper chain 58 engaged with upper chain sprocket 54 and lower chain sprocket 56. Referring to FIG. 2, there is a second tensioning cylinder 60 adapted to exert a force upon lower chain sprocket 56 of second gripper chain support 44 to cause relative movement of upper chain sprocket 54 and lower chain sprocket 56 to tension second gripper chain 58. Referring to FIG. 5, a second drive motor assembly 62 that consists of a motor 64, gear box 66 and brake 68 is used to drive upper chain sprocket 54 to move second gripper chain 58 along second bearing surface provided by second skate plate 52.

Figure 6:
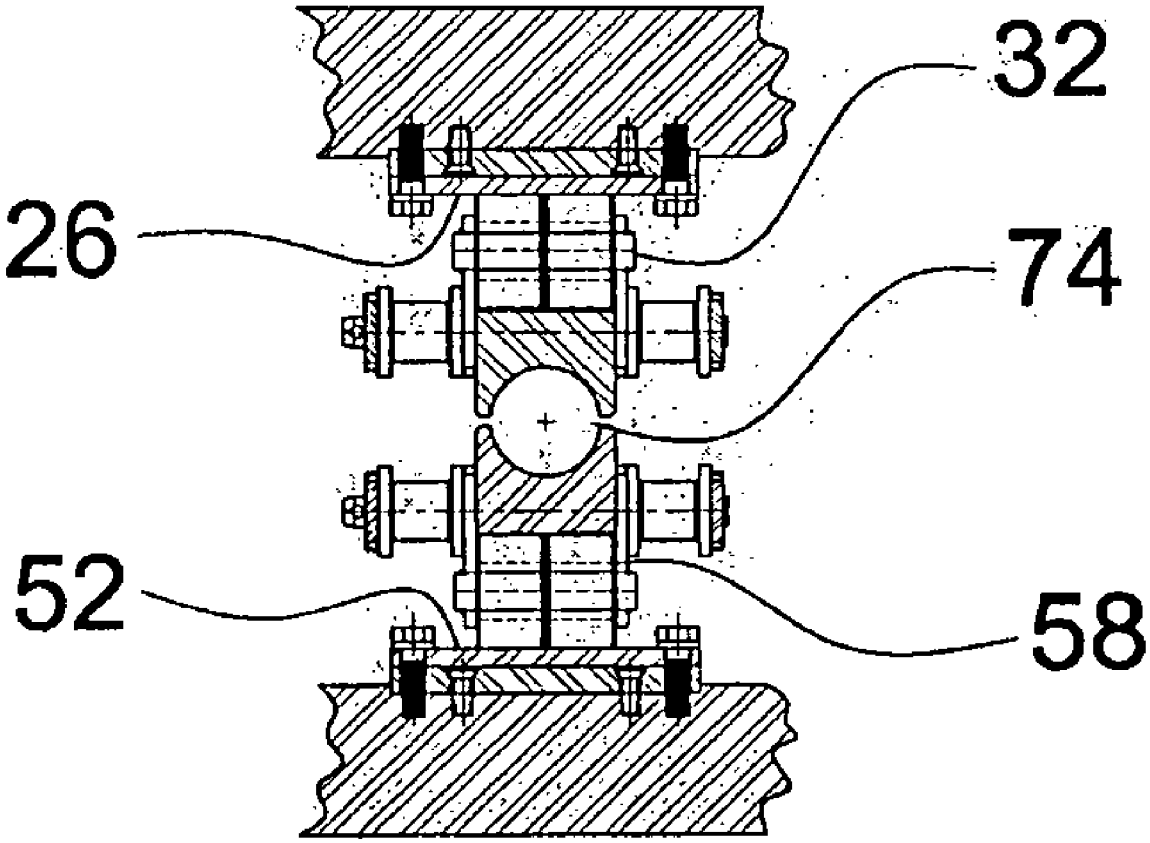
FIG. 6 is a detailed top plan view, in section, of bearing plate detail taken from FIG. 5.

Referring to FIG. 4, a tubing channel 74 is positioned between first gripper chain support 18 and second gripper chain support 44. FIG. 6 shows a detailed view of tubing channel 74 between bearing surfaces provided by first skate plate 26 and second skate plate 52. Referring to FIG. 2, telescopic cylinders 70 are secured to first skate plate 26 and second skate plate 52 and are used to create a relative movement of first gripper chain support 18 and second gripper chain support 44 along mounting track 14 of main body 12 while maintaining first bearing surface provided by first skate plate 26 and second bearing surface provided by second skate plate 52 in parallel spaced relation, whereby first gripper chain 32 and second gripper chain 58 can be moved into or out of engagement with tubing 72 positioned in tubing channel 74. For example, first gripper chain support 18 may be locked in a selected axial position along mounting track 14 using a lock 76, and telescopic cylinders 70 act upon second gripper chain support 44 to move second gripper chain support 44 axially along mounting track 14 either toward or away from first gripper chain support 28. For ease of servicing first gripper chain support 18 and the second gripper chain support 44 each have chain access windows 77 extending between the upper end and the lower end opposed to tubing channel 74.

Operation:

The use and operation of tubing injector head 10 will now be discussed with reference to FIGS. 1 through 6. Referring now to FIG. 2, tubing 72 is positioned within tubing channel 74 by extending telescopic cylinders 70 such that first and second gripper chain supports 18 and 44 are separated along mounting track 14 along axis 16, positioning tubing 72, then retracting telescopic cylinders 70 such that tubing 72 is gripped by first and second gripper chains 32 and 58. Referring to FIG. 4, first and second gripper chains 32 and 58 are engaged by upper chain sprockets 28 and 54 and lower chain sprockets 30 and 56, respectively. Sprockets 28 and 30 are supported by first gripper chain support 18 and sprockets 54 and 56 are supported by second gripper chain support 34. Gripper chains 32 and 58 move along bearing surfaces provided by first skate plate 26 and second skate plate 52, and are driven by upper sprockets 28 and 54 which are in turn driven by motor assemblies 36 and 62 respectively, which are shown in FIG. 5. Each motor assembly 36 and 62 includes motor 38 and 64, gear box 40 and 66, and brake 42 and 68. As gripper chains 32 and 58 are driven, tubing 72 is injected into a well (not shown).

Advantages:

The configuration of tubing injector head 10 described above provides a number of distinct advantages. A first advantage is that the contact area provided is much larger than that provided by tubing injector head systems that utilize drive chains to move the gripper chains. A second advantage is that less point force need be applied to the tubing, as the force is spread over the larger contact area. The amount of force applied at any given point along the tubing is important as, over time, the tubing experiences metal fatigue and begins to egg. Tubing injected with tubing injector head 10 experiences less fatigue and will last longer. A third advantage is that the telescopic cylinders used to effect movement are secured to first skate plate 26 and second skate plate 52. These skate plates are made of four inch thick steel, so that there is no deflection. A fourth advantage is that chain access windows 77 facilitate in situ on site chain replacement. Furthermore, in the event of a mechanical failure of any injector component, the injector can be opened to replace the failed section without having to cut the coil string to remove the injector in order to service it.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

What is claimed is:

1. A tubing injector head, comprising:

a main body adapted for mounting on a well, the main body having a gripper chain support mounting track;

a first gripper chain support mounted to the mounting track on the main body, the first gripper chain support having an upper end, a lower end, and a first skate plate providing a first bearing surface extending between the upper end and the lower end, an upper chain sprocket at the upper end, a lower chain sprocket at the lower end, a first gripper chain engaged with the upper chain sprocket and the lower chain sprocket;

a first drive motor driving one of the upper chain sprocket or the lower chain sprocket to move the first gripper chain along the first bearing surface;

means for detachably mounting the first gripper chain support to the mounting track on the main body to accommodate axial movement along the track while precluding transverse movement, and locking the first gripper chain support in a selected axial position along the mounting track;

a second gripper chain support mounted to the mounting track on the main body, the second gripper chain support having an upper end, a lower end and a second skate plate providing a second bearing surface extending between the upper end and the lower end, an upper chain sprocket at the upper end, a lower chain sprocket at the lower end, a second gripper chain engaged with the upper chain sprocket and the lower chain sprocket;

a second drive motor driving one of the upper chain sprocket or the lower chain sprocket to move the second gripper chain along the second bearing surface;

means for detachably mounting the second gripper chain support to the mounting track on the main body to accommodate axial movement along the track while precluding transverse movement and locking the second gripper chain support in a selected axial position along the mounting track;

a tubing channel positioned between the first gripper chain support and the second gripper chain support; and telescopic cylinders secured to the first skate plate and the second skate plate for creating relative movement of the first gripper chain support and the second gripper chain support while maintaining the first bearing surface and the second bearing surface in parallel spaced relation, whereby the first gripper chain and the second gripper chain can be moved into or out of engagement with tubing positioned in the tubing channel.

2. The tubing injector head as defined in claim 1, wherein the first gripper chain support and the second gripper chain support each have chain access windows extending between the upper end and the lower end opposed to the tubing channel.

3. The tubing injector head as defined in claim 1, wherein each of the first drive motor and the second drive motor has a gearbox and a brake.

4. The tubing injector head as defined in claim 1, wherein tensioning cylinders are provided which are adapted to exert a force to cause relative movement of the upper chain sprocket and the lower chain sprocket to tension the gripper chain.

5. A tubing injector head, comprising:

a main body adapted for mounting on a well, the main body having a mounting track with an axis;

a first gripper chain support mounted on the mounting track of the main body, the mounting track facilitating axial movement of the first gripper chain support while precluding transverse movement, the first gripper chain support having an upper end, a lower end, and a first skate plate providing a first bearing surface extending between the upper end and the lower end, an upper chain sprocket at the upper end, a lower chain sprocket at the lower end, a first gripper chain engaged with the upper chain sprocket and the lower chain sprocket;

a first tensioning cylinder adapted to exert a force upon the lower chain sprocket of the first gripping chain support to cause relative movement of the upper chain sprocket and the lower chain sprocket to tension the first gripper chain;

a first drive motor assembly consisting of a motor, gear box and brake for driving the upper chain sprocket to move the first gripper chain along the first bearing surface;

a second gripper chain support mounted on the mounting track of the main body, the mounting track facilitating axial movement of the second gripper chain support while precluding transverse movement, the second gripper chain support having an upper end, a lower end and a second skate plate providing a second bearing surface extending between the upper end and the lower end, an upper chain sprocket at the upper end, a lower chain sprocket at the tower end, a second gripper chain engaged with the upper chain sprocket and the lower chain sprocket;

a second tensioning cylinder adapted to exert a force upon the lower chain sprocket of the second gripper chain support to cause relative movement of the upper chain sprocket and the lower chain sprocket to tension the second gripper chain;

a second drive motor consisting of a motor, gear box and brake for driving the upper chain sprocket to move the second gripper chain along the second bearing surface;

a tubing channel positioned between the first gripper chain support and the second gripper chain support;

telescopic cylinders secured to the first skate plate and the second skate plate for creating relative movement of the first gripper chain support and the second gripper chain support along the mounting track of the main body while maintaining the first bearing surface and the second bearing surface in parallel spaced relation, whereby the first gripper chain and the second gripper chain can be moved into or out of engagement with tubing positioned in the tubing channel;

the first gripper chain support and the second gripper chain support each having chain access windows extending between the upper end and the lower end opposed to the tubing channel the first gripper chain support being locked in a selected axial position along the mounting track; and wherein the telescopic cylinders act upon the second gripper chain support to move the second gripper chain support axially along the mounting track either toward or away from the first gripper chain support.

* * * * *